US005695218A

United States Patent [19]

Nicosia

[11] Patent Number: 5,695,218

[45] Date of Patent: Dec. 9, 1997

[54] GLOW-IN-THE-DARK BOOK

[76] Inventor: Davide Nicosia, 16 W. 56th St. 3rd Floor, New York, N.Y. 10019

[21] Appl. No.: 437,416

[22] Filed: May 12, 1995

[51] Int. Cl.[6] ..... B42D 15/00

[52] U.S. Cl. ..... 281/38; 281/51; 283/92

[58] Field of Search ..... 281/51, 38; 40/542, 40/541, 544; 283/63.1, 92, 117, 95

[56] References Cited

U.S. PATENT DOCUMENTS

| | | | |
|---|---|---|---|
| 2,225,307 | 12/1940 | Kreeger . | |
| 2,685,638 | 8/1954 | Littrell et al. . | |
| 3,832,556 | 8/1974 | Schroeder | 250/462 |
| 3,978,340 | 8/1976 | Schroeder | 250/462 |
| 4,024,404 | 5/1977 | Schroeder | 250/462 |
| 4,035,652 | 7/1977 | Schroeder | 250/462 |
| 4,151,667 | 5/1979 | Idelson . | |
| 4,237,381 | 12/1980 | Schroeder | 250/462 |
| 4,266,164 | 5/1981 | Schroeder | 315/169.1 |
| 4,500,116 | 2/1985 | Ferro et al. | 283/92 |
| 4,725,761 | 2/1988 | Schroeder et al. | 315/169.3 |
| 4,745,286 | 5/1988 | Jones | 40/542 X |
| 5,005,873 | 4/1991 | West | 283/92 |
| 5,022,682 | 6/1991 | Desmond | 281/38 |
| 5,118,138 | 6/1992 | Brotz | 281/51 |
| 5,172,937 | 12/1992 | Sachetti | 283/81 |
| 5,301,982 | 4/1994 | Brotz | 283/83 |
| 5,381,310 | 1/1995 | Brotz | 362/32 |

*Primary Examiner*—Willmon Fridie, Jr.

[57] ABSTRACT

A glow-in-the dark book which contains at least one composite predetermined sheet and phosphorescent material. The phosphorescent material has the ability to glow in the dark after the glow-in-the dark book is subjected to a light source. The glow-in-the dark book can glow in the dark after only a one step exposure process.

19 Claims, 2 Drawing Sheets

GLOW-IN-THE-DARK BOOK

BACKGROUND OF THE INVENTION

1. Field of the Invention

The present invention relates to a glow-in-the-dark book. More particularly, the present invention relates to a glow-in-the-dark book that contains phosphorescent material disposed within each sheet of the glow-in-the-dark book. The phosphorescent material can glow in the dark when subjected to a light source. The indicia can be in the form of artwork and/or printed material.

2. Description of the Prior Art

Though the application, or use, of luminescent, fluorescent or phosphorescent, bodies, or matter, may be said to be known, this invention discloses steps and products which extend beyond such known practices or inventions.

It has been appreciated by non-braille readers that in order to read and/or see a non-braille book one must have ambient light to reflect off the pages of such book. Prior to this invention such ambient light was provided by an external and/or built-in light source device.

Numerous innovations for a glow in the dark book have been provided in the prior art that are described as follows. Even though these innovations may be suitable for the specific individual purposes to which they address, they differ from the present invention as hereinafter contrasted.

The Brotz U.S. Pat. No. 5,118,138 discloses the concept of providing a book with pages containing a fluorescent material, the material must be illuminated by an internal light source which is an integrated component of the book. In contrast to the present invention, there is no disclosure or suggestion in the Brotz '138 Patent that the fluorescent material exhibits an after-glow characteristic, whereby the material may by energized by an external light source, rather than by an internal one producing fluorescence and/or glowing effect. Because each page includes an opaque center layer specifically designed to prevent the simultaneous illumination of phosphorescent material on opposite sides thereof, the Brotz '138 Patent actually teaches away from this one-step exposure process of the present invention which is accomplished by permitting external light to simultaneously energize phosphorescent material contained on several different pages.

Numerous innovations for a glow in the dark book have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is the object of the present invention to provide a glow-in-the dark book that avoids the disadvantages of the prior art.

It is another object of the present invention to provide a glow-in-the dark book that is simple and inexpensive to manufacture.

It is another object of the present invention to provide a glow-in-the dark book that is useful to comfort, amuse people of all ages and imply security to a person who is afraid of the dark.

It is another object of the present invention to provide a glow-in-the dark book that includes at least one composite predetermined sheet and phosphorescent material.

It is another object of the present invention to provide a glow-in-the dark book wherein the phosphorescent material is disposed within the composite predetermined sheet(s).

It is another object of the present invention to provide a glow-in-the dark book wherein the phosphorescent material has the ability to glow in the dark after it has been exposed and/or subjected to a light source.

It is another object of the invention to provide a glow-in-the dark book that can glow in the dark after only a one step exposure process.

It is another object of the present invention to provide a glow-in-the dark book wherein the phosphorescent material can be read and/or seen without re-exposing each sheet to a light source.

It is another object of the present invention to provide a glow-in-the dark book wherein the phosphorescent material is in the form of predetermined printed artwork or prose.

It is another object of the present invention to provide a glow-in-the dark book wherein the composite predetermined sheet is made of polyvinyl chloride or any other equivalent material.

It is another object of the present invention to provide a glow-in-the dark book wherein the phosphorescent material is made of phosphorescent zinc sulfide or any other equivalent material.

It is also the object of the present invention to provide a glow-in-the dark book wherein the phosphorescent material is attached to the composite predetermined sheet by a matrix material.

It is another object of the present invention to provide a glow-in-the dark book wherein the matrix material is water soluble and/or capable of self-expansion in water.

Yet another novel feature of the present invention is that the indicia that is glow in the dark and/or fluorescent may also be raised in its configuration functioning as braille so that both blind and non-blind persons can utilize the same book. In addition the raised and non-raised indicia can be present concurrently on a single page. The indicia can be selected from a group consisting of pictures, letters, numbers, images and artwork.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing(s).

BRIEF LIST OF REFERENCE NUMERALS UTILIZED IN THE DRAWING

10—glow-in-the dark book 10;
14—phosphorescent material 14;
16—book binder 16;
18—front book cover 18;
19—back book cover 19;
20—composite predetermined sheet 20;
22—glowing light 22;
24—incandescent lamp 24;
26—light 26.

BRIEF DESCRIPTION OF THE PREFERRED EMBODIMENT

DETAILED DESCRIPTION OF THE PREFERRED EMBODIMENT

As mentioned, the present invention broadly involves the integration of phosphorescent material a composite predetermined sheet 20 to provide a novel way to read and see in the dark. Accordingly, in that broad sense, the phosphorescent material 14 can be integrated with the composite predetermined sheet 20 by disposing the phosphorescent material 14 on at least one surface of the composite predetermined sheet 20. This preferred embodiment will be better appreciated by reference to the Figures.

Alternatively, the phosphorescent material 14 could be integrated with a protective plastic sheet and/or film of the composite predetermined sheet 20. The covering material should be sufficiently transparent at the appropriate frequencies that excitation of the luminescent pigments is possible and the emitted glow is clearly visible when irradiated and viewed through the covering material.

Figure 1:
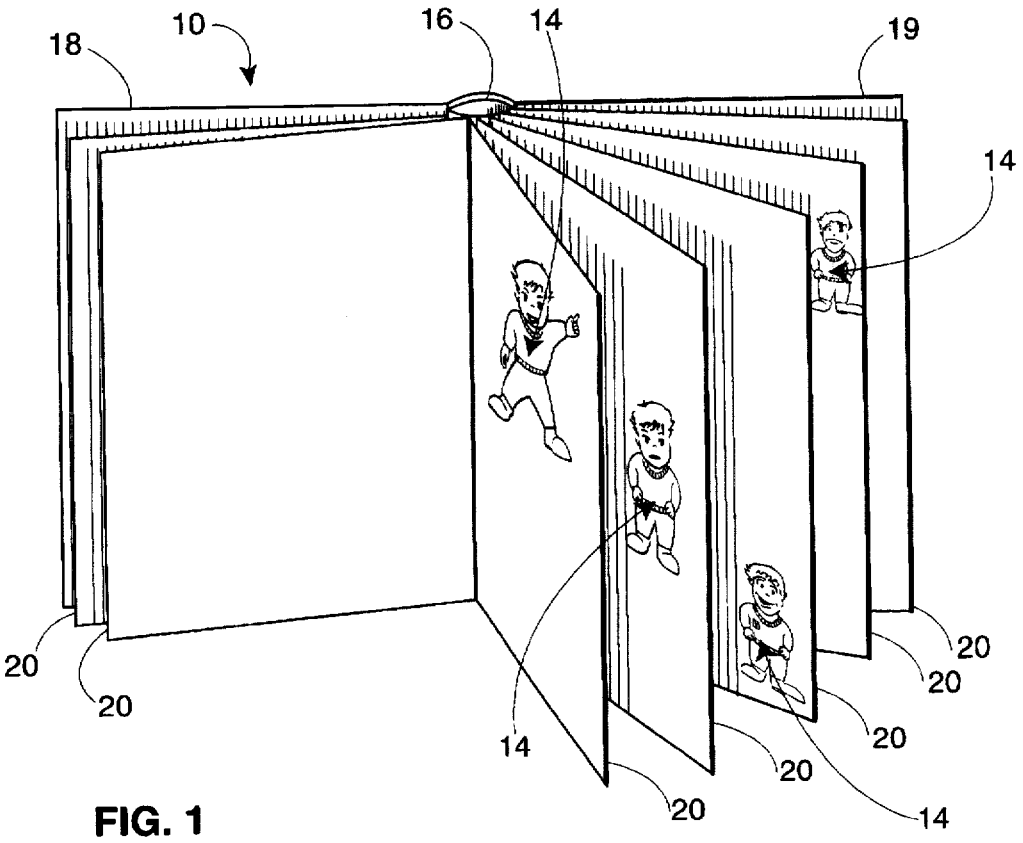
FIG. 1 is a perspective view of the glow-in-the dark book in an open position as it appears under normal light.

Referring now to FIG. 1 which illustrates a glow-in-the dark book 10 that contains at least one composite predetermined sheet 20 attached to a book binder 16. The book binder 16 has a book front cover 18 and a book rear cover 19. The glow-in-the dark book 10 can open and close and the composite predetermined sheets 20 can be turned as a conventional book. Either or both the book front cover 18 and the book rear cover 19 may be provided with printed material, such as a title, author, publisher, etc. The composite predetermined sheets 20 can be made of thin predetermined rigid and/or semi rigid material such as polyvinyl chloride and have phosphorescent material 14 disposed on them. The phosphorescent material 14 can be in the form of artwork indicia as seen on the right side of the composite predetermined sheets 20 illustrated in FIG. 1.

Figure 2:
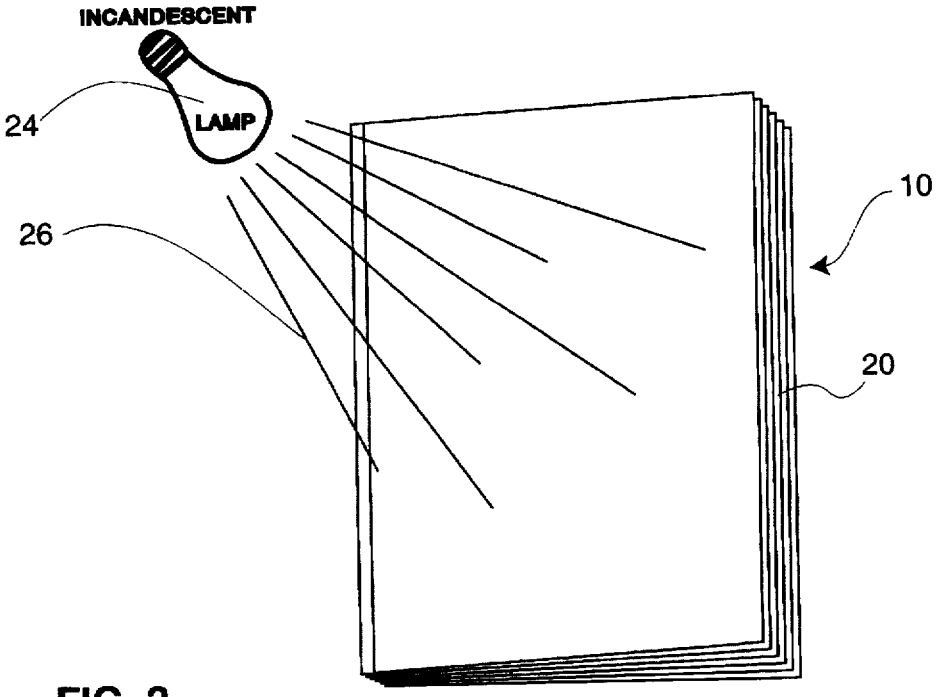
FIG. 2 is a perspective view of the glow-in-the dark book in a closed position with pages of the present invention subjected to light from an incandescent lamp.

Referring to FIG. 2 which exhibits the glow-in-the dark book 10 being exposed and/or subjected and/or irradiated by light 26 from an incandescent lamp 24. The composite predetermined sheets 20 can consist of rigid and/or semi-rigid polyvinyl chloride sheets such as "PENTACLEAR-BX388" sold by Klöckner-Pentaplast of America, Inc., or the equivalent. Artwork of phosphorescent material 14 can be made with commercially available luminescent pigment/zinc sulfide mixture such as "GLO-PIGMENT SERIES 1000" sold by Conrad Hanovia, Inc., or the equivalent material.

Figure 3:
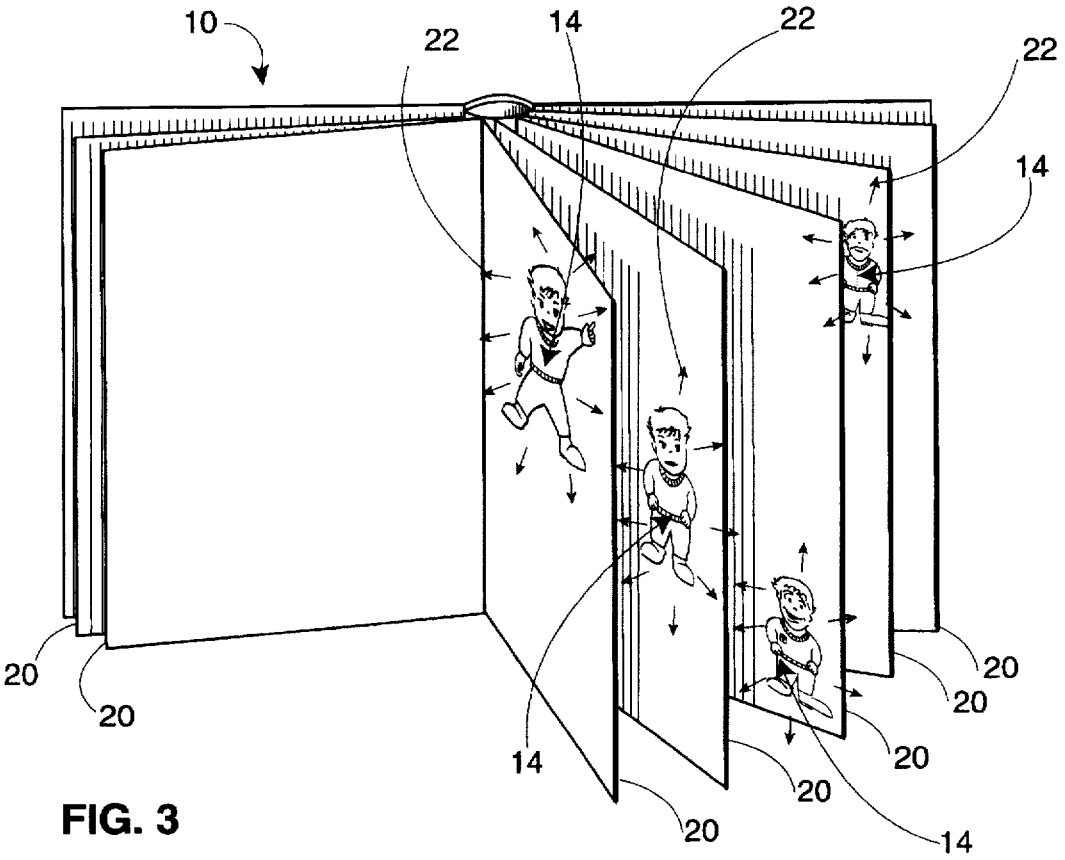
FIG. 3 is a perspective view of the glow-in-the dark book in an open position after having been irradiated by an incandescent lamp and placed in the dark.

During use, as exhibited in FIG. 3, when the glow-in-the dark book 10 in its closed position has been subjected to a light source like incandescent lamp 24 or day light, or black light lamp, energy will activate the phosphorescent material 14 on the composite predetermined sheets 20. When the glow-in-the dark book 10 is placed in a dark environment, glowing light indicated by arrows 22 will emit from each composite predetermined sheet 20. An observer in the dark would be able to read or see phosphorescent material 14 on each composite predetermined sheet 20 without re-exposing each time the next composite predetermined sheet 20 to the light source. The glowing material will be sustained in the darkness for a period of time.

In the preferred embodiment of the invention, the phosphorescent material 14 applied and/or disposed to the surface of each composite predetermined sheet 20 of the glow-in-the dark book 10 in the form of predetermined printed artwork. This can be easily accomplished by dispersing and/or disposing the phosphorescent material 14 in a suitable medium and applying the phosphorescent material 14 to the surface of the composite predetermined sheet 20 by known printing methods, such as silk screening and/or thermoprinting and/or off set techniques. Some plastic sheet material have an inherent adhesive capability such as polyvinyl chloride and in such instances, the artwork of phosphorescent material 14 can be coated directly on a surface of such composite predetermined sheet 20 material.

The preferred particle size of the phosphorescent material 14 is to be a particle size approximately 5–10 microns in diameter. Other suitable particular size for the phosphorescent material 14 is to be in the range of 2–20 microns. Also, the phosphorescent material 14 to matrix ratio should be high and the binder should not completely wet the particle so that some air can remain associated with at least some portion of the pigment particle(s) so that some air interface may be provided between those portions of the particle and the matrix material on coating or printing the artwork.

An especially suitable dispersion of luminescent material effectively used in the practice of this invention is as follows:

| DISPERSION A | PARTS |
|---|---|
| Matrix (2.8% Solution of Rohm & Haas ASE-60)[1] | 44.6 |
| Pigment (Glo-pigment Series 1000)[2] | 50.0 |
| Water | 5.4. |
| Ammonia to bring pH to 9.0 | |

[1]Rohm & Haas is a commercially available emulsion of polyacrylic acid sold by Rohm & Haas, Inc.
[2]Glo-Pigment Series 1000 is a commercially available phosphorescent zinc sulfide sold by Hanovia, Inc.

The total solids of Dispersion A is about 41.25% and the dispersion is printed preferably by silk screen techniques. On drying, a printed artwork of Dispersion A comprises about 40 parts of phosphorescent material to about 1 part matrix. A printed artwork having a high phosphorescent material to matrix ratio, e.g., between about 20:1 to about 50 or 60:1, is preferred because such ratios provide efficient visibility of the artwork at low light levels.

Many phosphors are commercially available and emit different colors and continue to emit radiation for different periods of time after they are removed from ambient light. Accordingly, the selection of particular phosphors or combinations of phosphors to provide predetermined characteristics is another factor that can be employed in the present invention to create different kinds of phosphorescent artworks.

While the invention has been illustrated and described as embodied in a glow-in-the dark book, it is not intended to be limited to the details shown, since it will be understood that in the forms and details of the glow-in-the dark book illustrated and in its operation can be made by those skilled in the art without departing any way from the spirit of the present invention.

It will be understood that each of the elements described above, or two or more together, may also find a useful application in other types of constructions differing from the type described above.

While the invention has been illustrated and described as embodied in a glow in the dark book, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A glow-in-the-dark book comprising:

a) a plurality of sheets;

b) phosphorescent material disposed upon at least some of said sheets, wherein said phosphorescent material can be activated by radiant energy to glow in the dark;

c) each of said sheets with phosphorescent material having two sides and being substantially light-transmitting so as to permit said phosphorescent material to be activated by radiant energy received at either of said two sides; and a holding device for holding said plurality of sheets together;

wherein said phosphorescent material on all of said sheets with phosphorescent material can be simultaneously activated, with said sheets held together by said holding device, by a single exposure of radiant energy.

2. A glow-in-the-dark book as in claim 1, wherein said holding device is a binding which holds said plurality of sheets together to form a book.

3. A glow-in-the-dark book as in claim 2, wherein said phosphorescent material on each of said sheets is in the form of indicia which can be distinguished in the dark when activated, and wherein said sheets are substantially translucent, whereby said indicia on a given sheet within said book can be activated by radiant energy with said book closed, but cannot be distinguished unless said given sheet is exposed to view.

4. The glow-in-the-dark book of claim 1, wherein said at least one sheet is made of polyvinyl chloride.

5. The glow-in-the-dark book of claim 1, wherein said phosphorescent material comprises a matrix material which is water soluble.

6. The glow-in-the-dark book of claim 1, wherein said phosphorescent material comprises a matrix material which is self-expandable in water.

7. The glow-in-the-dark book of claim 1, wherein said phosphorescent material is in the form of indicia.

8. The glow-in-the-dark book of claim 7, wherein said indicia are selected from the group consisting of pictures, letters, numbers, images and artwork.

9. The glow-in-the-dark book of claim 6, wherein said phosphorescent material has a particle size in the range of 2 to 20 microns in diameter.

10. The glow-in-the-dark book of claim 9, wherein said phosphorescent material has a particle size between about 2 to about 20 microns dispersed in matrix material and the ratio of phosphorescent material to matrix material is in the range of 20:1 to 60:1.

11. The glow-in-the-dark book of claim 1, wherein said phosphorescent material is a phosphorescent zinc sulfide.

12. A glow-in-the-dark book as in claim 1, wherein said radiant energy is selected from the group consisting of incandescent light, daylight, and ultraviolet light.

13. A glow-in-the-dark book as in claim 1, wherein said phosphorescent material is disposed within said sheet.

14. A glow-in-the-dark book as in claim 13, wherein said phosphorescent material is disposed on a surface of said sheet.

15. A glow-in-the-dark book as in claim 1, wherein said phosphorescent material is disposed on a surface of said sheet.

16. A glow-in-the-dark book as in claim 1, wherein said sheet is substantially transparent.

17. A glow-in-the-dark book as in claim 1, wherein said sheet is substantially translucent.

18. A glow-in-the-dark book comprising:

a plurality of sheets, at least some of which having indicia thereon, said indicia comprising a phosphorescent material which can be activated by radiant energy to glow in the dark;

a holding device which holds said plurality of sheets together; and said sheets being substantially open to radiant energy and being substantially light-transmitting so that all of said indicia can be activated simultaneously by a single exposure of radiant energy.

19. A glow-in-the-dark book as in claim 18, wherein said indicia on each of said sheets can be distinguished in the dark when activated, and wherein said sheets are substantially translucent, whereby said indicia on any given one of said sheets can be activated by radiant energy while said sheets are held together, but cannot be distinguished unless said given sheet is exposed to view.

* * * * *